United States Patent [19]

Sutton

[11] 4,007,914

[45] Feb. 15, 1977

[54] JACKING MECHANISM

[76] Inventor: John R. Sutton, P.O. Box 32, Beaumont, Tex. 77704

[22] Filed: June 17, 1975

[21] Appl. No.: 587,705

[52] U.S. Cl. ..... 254/108; 61/98

[51] Int. Cl.[2] ..... B66F 1/00; E02D 21/00

[58] Field of Search ..... 254/105, 108–111, 254/89 R, 89 H; 61/46.5

[56] References Cited

UNITED STATES PATENTS

| | | | |
|---|---|---|---|
| 2,992,812 | 7/1961 | Rasmussen et al. | 254/107 |
| 3,056,585 | 10/1962 | Smulders | 254/110 |
| 3,804,369 | 4/1974 | Sutton | 254/105 |

*Primary Examiner*—Al Lawrence Smith
*Assistant Examiner*—Robert C. Watson
*Attorney, Agent, or Firm*—Burns, Doane, Swecker & Mathis

[57] ABSTRACT

Jacking apparatus is disclosed for effecting relative vertical movement between an upright leg and a platform. The jacking apparatus comprises a frame which includes a cross member mounted on the platform. Vertically spaced first and second fluid cylinders are carried by the platform, with the first cylinder being mounted on the cross member. Each fluid cylinder carries a beam and a holding device for selectively coupling the beam to the leg. The power cylinders and the holding devices are operated 180° out of phase to effect step-by-step movement of the platform relative to the leg. Power transfer chains operably connect the first and second fluid cylinders to the cross member of the support frame to transfer forces from the first and second fluid cylinders directly to the cross member. As a result, a relatively balanced distribution of vertical forces is applied to the cross member thereby reducing its size requirements. A support frame includes an integral frame assembly arranged to be secured as a unit to the platform. A shock absorber mounting is provided for connecting the frame assembly to the platform and for absorbing forces transmitted between the platform and the leg. The shock absorber mounting includes a resilient pad formed of alternate layers of metal and resilient material. Cylinders may be arranged without power transfer means such that the application of pressure fluid against the head ends of the cylinder piston rods serves to raise the platform, thereby providing maximum lifting power during a platform raising operation.

23 Claims, 25 Drawing Figures

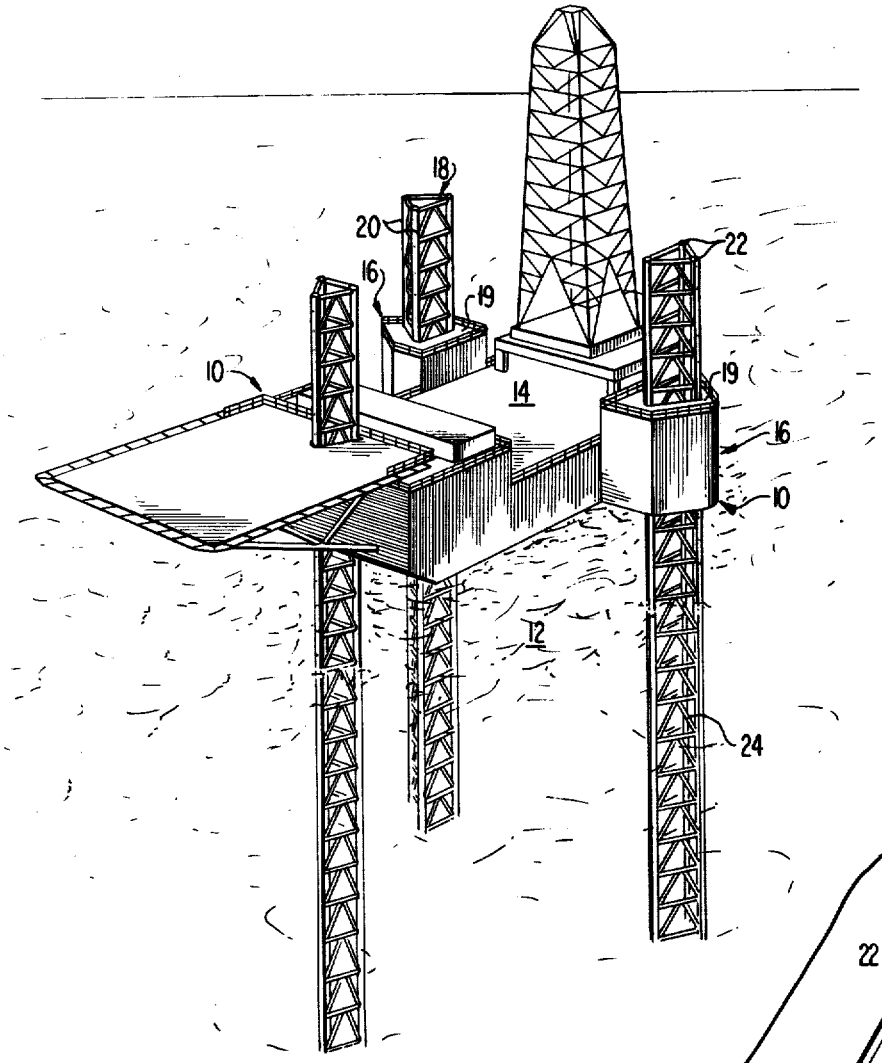
FIG. 1
FIG. 2
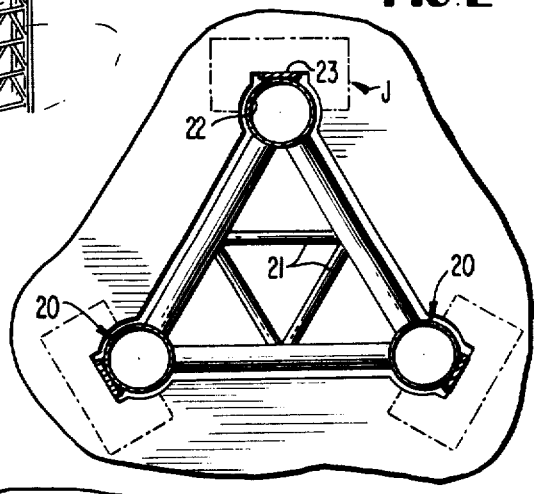
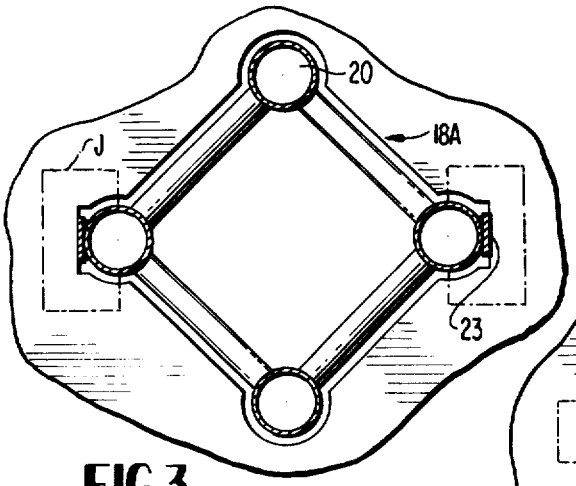
FIG. 3
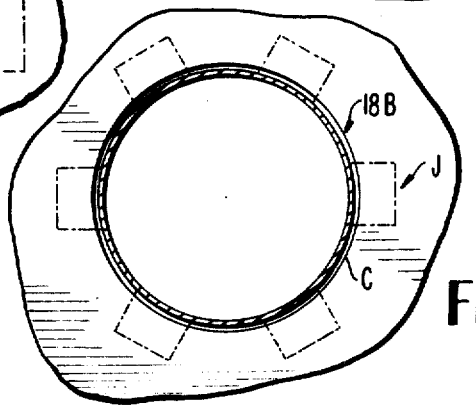
FIG. 4

JACKING MECHANISM

BACKGROUND OF DISCLOSURE

This invention relates to improvements in jacking mechanisms, and more particularly, to jacking mechanisms for an offshore platform to effect relative vertical movement of the platform with respect to supporting legs carried thereby.

Offshore platforms are generally employed for supporting oil-drilling equipment or servicing equipment in the open sea. It is desirable that the platform be elevated above the water surface so as to be relieved of the effects of wave action. Customarily, the platform is mounted on a plurality of supporting legs which are lowered to the waterbed, and the platform is raised thereon to an elevated position above the water surface for effecting the necessary offshore operations.

Jacking mechanism is deployed on the platform for effecting relative vertical movement between the platform and the legs. While numerous forms of jacking mechanisms have been proposed heretofore (e.g., see U.S. Pat. Nos. 2,947,148 and 2,992,812), a highly efficient assembly has been disclosed in my U.S. Pat. No. 3,804,369 issued Apr. 16, 1974. In that patent, there is set forth a jacking mechanism including a pair of fluid-actuated, extendable and retractable jacking cylinders which can be coupled and uncoupled individually relative to the associated leg. The cylinders are double-acting and are operated 180° out-of-phase such that one cylinder is being extended while the other is being retracted. A flexible line arrangement operatively connects the two cylinders such that the power output of one cylinder can be transmitted effectively to assist the other cylinder. Thus, both of the cylinders act in unison even though moving out-of-phase. Such alternating, synchronized operation utilizes maximum power and affords continuous jacking action without the pauses required to extend the jacks for alternate strokes which had been required previously.

Notwithstanding the highly unique features and significant advantages of my afore-described patented system, there remains room for improvement, especially in connection with installation of jacking mechanisms aboard the platform, isolation of the platform from shocks and other abrupt forces, and an efficient distribution of forces that are generated during jacking.

It is, therefore, an object of the present invention to improve the jacking mechanism to provide for easy installation on a platform.

It is another object of the invention to provide for isolating the jacking mechanism from serious shocks and other abrupt force applications.

It is a further object of the invention to provide for effectively distributing the jacking forces to minimize the stress being applied to the jacking mechanism support structure.

It is yet another object of the invention to reduce the cost of jacking systems and in which forces are effectively transferred between a pair of step-by-step jacking assemblies.

BRIEF SUMMARY OF INVENTION

In accomplishing these objects the present invention involves jacking apparatus which effects relative vertical movement between a platform and an upright leg. The jacking apparatus comprises vertically spaced upper and lower support structures carried by the platform. A first power mechanism is mounted on the upper support structure. A first movable member is connected to the first power mechanism for vertical movement in response to actuation of the first power mechanism. A first holding device is carried by the first movable member for selectively coupling the first movable member against vertical movement relative to the leg, wherein actuation of the first power mechanism produces movement between the platform and the leg. A second power mechanism is mounted on the lower support structure. A second movable member is connected to the second power mechanism for vertical movement in response to actuation of the second power means. A second holding device is carried by the second movable member for selectively coupling the second moveable member against vertical movement relative to the leg, wherein actuation of the second power mechanism produces relative movement between the platform and the leg. A power transfer system operably connects the upper support structure to the first and second movable members to transfer forces to the upper support structure from both of the first and second power mechanism during jacking of the platform by reverse-phase operation of the movable members.

In another aspect of the present invention a jacking apparatus comprises an integral frame assembly arranged for securement as a unit to the platform. A power mechanism is mounted on the integral frame assembly for effecting vertical movement of the leg relative to the platform. A shock absorber mounting secures the frame assembly to the platform and absorbs forces transmitted between the platform and the leg. The shock absorber mounting comprises a resilient structure interposed between the platform and the integral frame assembly. The resilient structure is sufficiently yieldable to permit controlled relative movement between the frame assembly and the platform in response to sudden jarring of the leg.

BRIEF DESCRIPTION OF THE DRAWINGS

Several preferred embodiments of the invention are illustrated in the accompanying drawings in which;

FIG. 1 is a perspective view of an offshore platform seated upon support legs in a body of water;

FIG. 2 is a schematic, cross-sectional view of one form of leg suitable for supporting the platform of FIG. 1;

FIG. 3 is a schematic, cross-sectional view of another form of leg suitable for supporting the platform;

FIG. 4 is a schematic cross sectional view of a further form of leg suitable for supporting the platform;

DETAILED DESCRIPTION OF THE PREFERRED EMBODIMENTS

Figure 5:
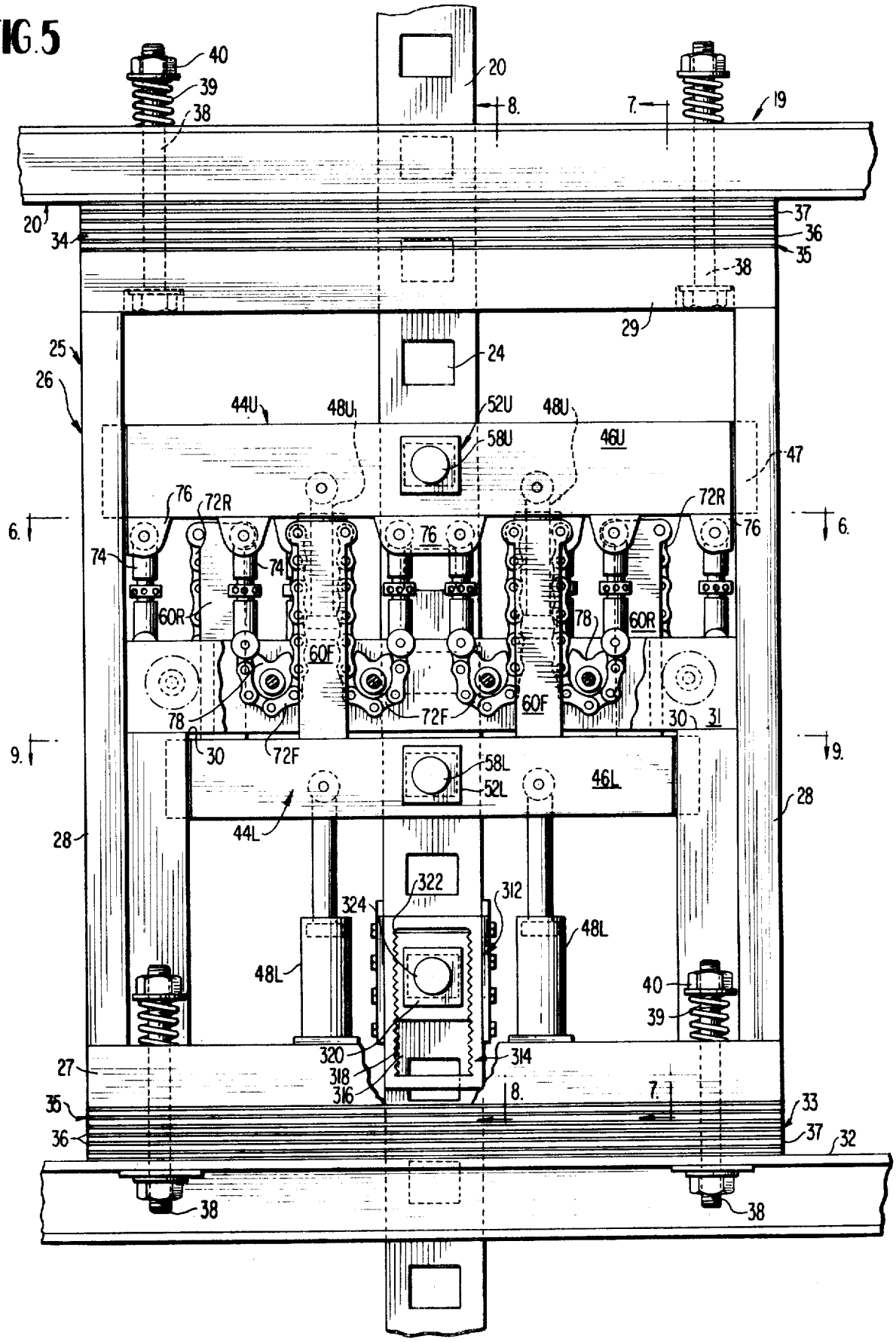
FIG. 5 is a front elevational view of one preferred form of jacking mechanism for effecting relative movement between the platform and legs, in accordance with the present invention.

The preferred forms of the invention are illustrated in connection with a platform 10, preferably in the form of a floatable barge. The platform is depicted in FIG. 1 as being situated in or above a body of water 12. This platform includes a deck 14 capable of carrying appropriate drilling or servicing equipment. Jack houses 16 are located at a plurality of positions on the platform. An upright platform leg 18 extends through a roof 19 of each jack house and is arranged for vertical movement through the jack house as will be subsequently explained.

In normal practice, the platform 10 is floated to the drilling or service site whereupon the legs 18 are jacked-down relative to the barge into engagement with the waterbed. Subsequent jacking raises the platform to an elevated position above the water surface, free from the action of waves.

The legs 18 may assume various configurations, with one suitable configuration, shown in FIGS. 1 and 2, comprising a plurality of upright chords 20 secured in triangular, spaced relation by bracing members 21. Among other suitable configurations are a diamond-shaped leg arrangement 18A depicted in FIG. 3 utilizing four chords 20, and a leg 18B composed of a single large cylindrical column C (FIG. 4).

The jack houses 16 each admits passage of a leg 18 and house a jacking mechanism J for actuating such associated leg. While the several jacking mechanisms of the legs 18 may be operated in concert, independent operation is usually preferred since the legs generally must be lowered to different extents to accommodate irregularities in the waterbed such as the ocean floor.

Each of the chords 20 being acted upon by the jacking mechanism may comprise a curved rear portion 22 and a front plate 23 (FIGS. 2 and 6) which plate forms a jack track on the leg chord. The jack track plate 23 has recesses or openings 24 (FIG. 5) spaced at intervals along the length thereof. As will be explained subsequently, these openings, in conjunction with the jacking mechanism, effect step-by-step movement of the leg 18 with respect to the platform 10. The jacking mechanism may be arranged to act upon one or more of the chords 20 of the leg 18. In the case wherein the leg 18B comprises a large cylindrical column C (FIG. 4), a plurality of jacking mechanisms may act upon the column.

PREFERRED EMBODIMENT OF FIGS. 5–10

With reference to FIG. 5, the jacking mechanism is in the form of a jacking unit 25 which can be substantially preassembled and installed as a package in the jack house 16. The jacking unit 25 comprises an integral support frame structure 26 which includes a base frame section 27, a pair of side frame sections 28, and a top frame section 29. Along their lower extents, the side frame sections 28 are of thicker construction to define opposed ledges 30 which support the ends of a cross member 31. These side frame sections 28 and cross member 31 are preferably fabricated of steel and are welded together to form an integral, fabricated unit.

The frame unit 25 is secured between the deck 32 and the roof 19 of the jack house 16 by lower and upper shock absorber mountings 33 and 34, respectively. Each shock absorber mounting comprises a resiliently compressible pad 35 formed of alternate layers of steel plates 36 and resilient mats 37 sandwiched together. The mats 37 are formed of appropriate elastic materials, such as rubber or neoprene for example. The shock absorber mountings further include upper and lower flexible connectors including upper and lower bolts 38. These bolts 38 extend through aligned apertures in the compressible pads 35 and the roof and floor of the jack house, respectively. Coiled compression springs 39 are mounted at the ends of the bolts and are retained by threaded nuts 40. The tensioning of each spring is adjustable by the nut 40. Thus, the bolts 38 guide the upper and lower frame portions 29, 27 for vertical floating movement while the extent of such movement is limited. The dual-action springs 33, 34, 39 serve to absorb shock in both directions of movement.

The preassembled support frame 25 is secured to the jack house roof 19 and deck 32 by the bolts 38. A plurality of steel plates and resilient mats are inserted between the frame structure and the roof and floor of the jack house to provide a resilient pad occupying the spacing therebetween. The bolts 38 and springs 39 are then installed to anchor the frame structure yieldably.

The integral support frame structure 26 is thus easily prefabricated in a shop for installation within a jack house. Installation time is reduced by reason of the prefabrication. The shock absorber mountings provide a cushioning effect against the significant shocks that can occur during jacking. The use of selectively insertable plates and resilient mats eliminates the need for a close-tolerance dimensioning of the frame structure relative to the height of the jack house, since the thickness of the compressible pads can be varied in accordance with the spacing between the frame structure and the jack house roof and deck.

With reference to FIGS. 5 through 9, it can be seen that the jacking unit 25 further comprises upper and lower jack assemblies 44U, 44L, respectively, which are mounted on the support frame structure 26. The upper jack assembly 44U includes an upper steel beam 46U forming a pin carrier, and a pair of upstanding fluid cylinders 48U. The upper beam 46U has end tongues 47 that are slidably mounted in guide slots formed in the side frame sections 28 (FIG. 5). The cylinders 48U are mounted on the cross member 31. These cylinders 48U are fluid actuated, and include retractable and extendable piston rods which are coupled to the upper beam 46U (FIG. 5).

Carried on the upper beam 46U is an upper holding or pin assembly 52U. This holding assembly includes a shiftable connector pin 46U (FIG. 8) and a fluid motor, preferably a fluid cylinder 58U, for reciprocating the pin 56U toward and away from the associated chord 20. In this fashion, the pin 56U can be inserted and withdrawn alternately from selective ones of the openings 24 within the chord. By inserting the pin 56U into the chord 20, the upper beam 46U becomes united with the chord. With the pin 56U in a retracted, i.e., non-engaged, posture, the upper beam 46U can be raised and lowered relative to the lower beam 46L by suitable actuation of the upper power cylinders 48U.

Figure 9:
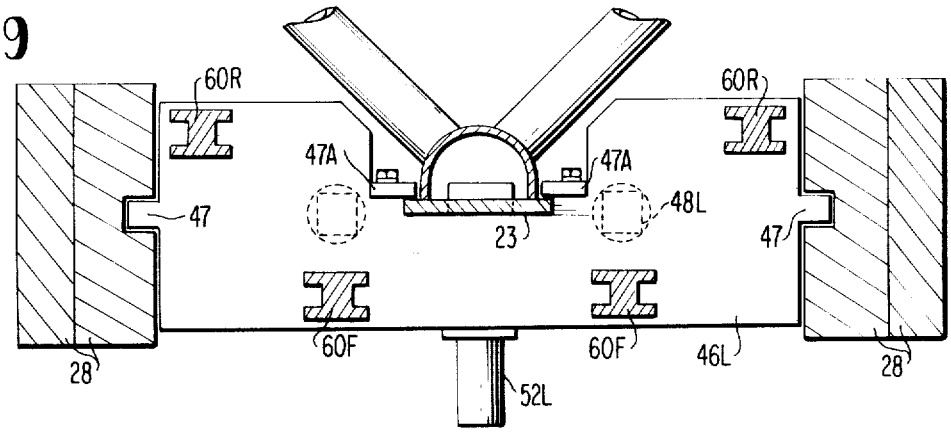
FIG. 9 is a cross-sectional view taken along line 9—9 in FIG. 5.

The lower jacking assembly 44L comprises a pair of lower fluid cylinders 48L which are similar to the upper cylinders 48U and are mounted on the base portion 27 of the support frame 26. The piston rods of the lower cylinders 48L are connected to a lower steel beam 46L which forms a pin carrier. Tongues 47 formed at the ends of the lower beam 46L serve to guide this beam slidably within the side frame sections 28 (FIGS. 5, 9). In addition, a pair of plates 47A (FIG. 9) secured to the lower beam 46L define a track for slidably receiving the jack track plate 23 of the chord 20. A similar guide may be provided for the upper beam 46U.

The lower beam 46L includes a lower pin assembly 52L, which includes a connector pin 56L (FIG. 8) and a power cylinder 58L for reciprocating the pin into and from the openings 24 in a manner similar to the upper pin assembly 52U. Thus, the lower pin 56L may be coupled for movement with the chord 20, or disengaged therefrom so as to be movable relative thereto.

Figure 6:
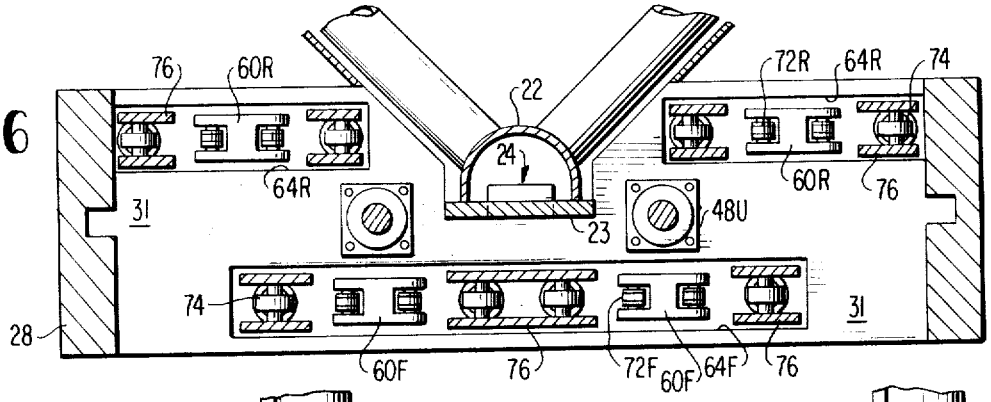
FIG. 6 is a cross-sectional view taken along line 6—6 in FIG. 5.
Figure 7:
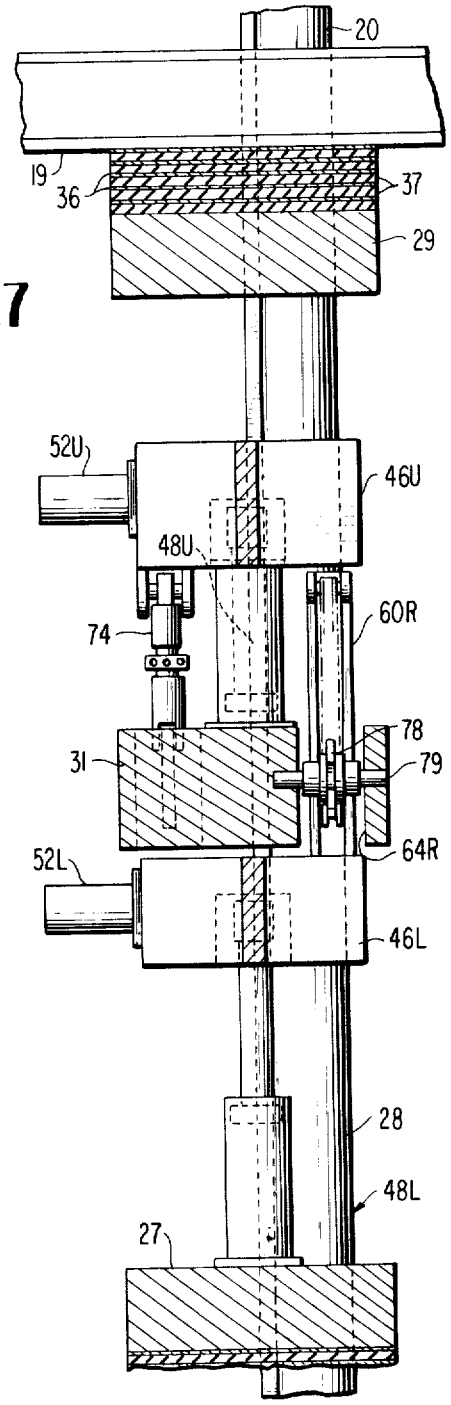
FIG. 7 is a vertical-sectional view taken along line 7—7 in FIG. 5.
Figure 8:
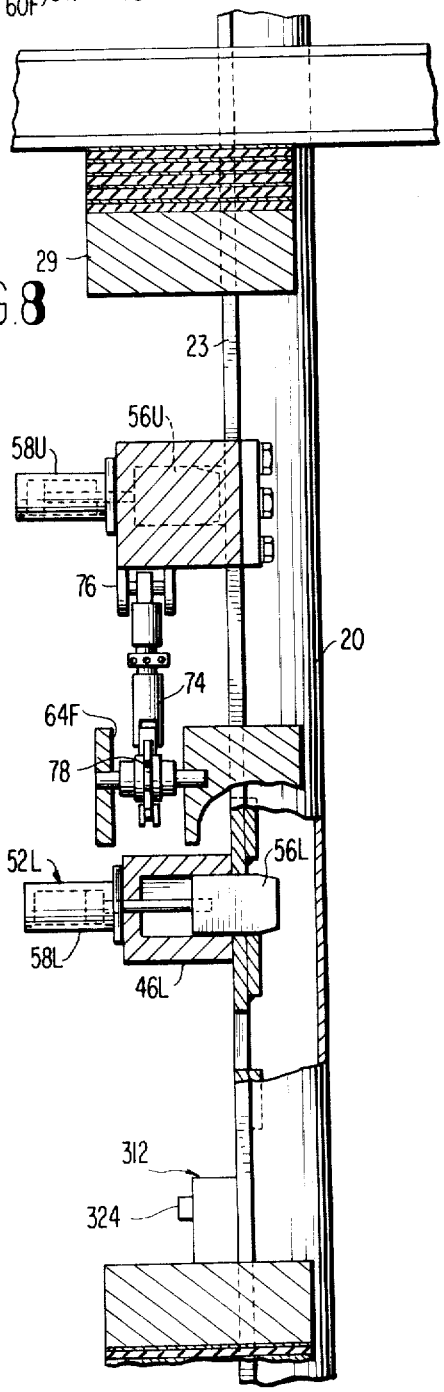
FIG. 8 is a vertical-sectional view taken along line 8—8 in FIG. 5.

The lower pin carrier 46L includes upright posts 60F, 60R disposed adjacent front and rear sides thereof (FIGS. 5, 6, 9). These posts are rigidly mounted on the lower beam 46L and are oriented to pass vertically through slots 64F, 64R formed in the cross member 31 (FIGS. 6, 9).

Operably connected between the upper and lower jacking assemblies 32U, 32L, is a force transfer assembly. In this embodiment, the force transfer assembly comprises a pair of flexible lines, preferably in the form of front and rear steel chain segments 72F, 72R. Each chain segment is operably connected in force transmitting relationship between the upper and lower beams 46U, 46L.

One end of each chain segment is coupled to the lower end of a turnbuckle 74, the upper end of which is connected to an ear 76 rigidly depending from the upper beam 46U. The other end of each chain segment is coupled to an upper end 56 of a post 60F, 60R. The arrangement is such that each post 60F, 60R has connected thereto the ends of a pair of chain segments 72F, 72R. Each chain segment passes around a sprocket wheel 78 (FIG. 7) which is rotatably mounted on an axle 79 secured to the cross member 31 within the slots 64F, 64R.

The upper and lower fluid cylinders 48U, 48L are connected in a suitable fluid pressurizing system which selectively supplies and receives fluid from the opposite ends of the cylinders, as will be apparent. The arrangement is such that the upper and lower cylinders 48U, 48L travel 180° out-of-phase, i.e., the upper cylinders retract while the lower cylinders extend, and vice-versa. By virtue of such reverse phase operation, the beams 46U and 46L may each be raised or lowered individually.

As described in the afore-mentioned U.S. Pat. No. 3,804,369, such operation, in conjunction with alternate connection of the pin carriers with the associated platform leg 18 effects a step-by-step movement of the leg relative to the platform 10.

The force transfer assembly 72F, 72R, 78, enables the power output of the upper and lower power cylinders 48U, 48L to be effectively combined while raising the platform along to the legs 18, without imposing undue stress on the cross member 31 of the support frame structure.

AUXILIARY HOLDING MECHANISM

Returning briefly to FIG. 5, there is depicted therein an auxiliary holding mechanism 312. This auxiliary holding mechanism includes a housing 314 secured to the base 27 of the frame unit 26. The housing 314 includes a slot 316 formed by a series of teeth or ridges 318. A pin block 320 is slidably mounted in the slot 316 and carries ridges 322 which mate with the slot ridges 318 to provide vertically adjustable positioning of the block 320 within the slot. The block 320 carries a pin mechanism 324 which is operable to extend selectively and retract a pin toward and away from the leg apertures 24. Thus, when the jacking operations are to be suspended, such as when the platform has been raised to its full height, the auxiliary pin mechanism 324 is actuated to secure the platform to the leg. Adjustment of the block 320 within the slot can be effected to align the holding mechanism with the leg aperture to be engaged.

OPERATION

Figure 10A:
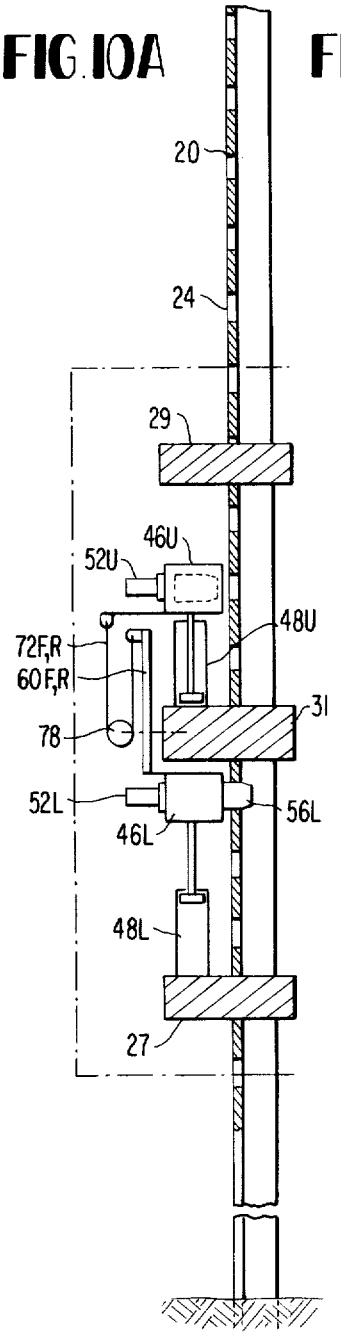
FIGS. 10A, 10B, 10C and 10D are schematic views depicting sequential operation of the jacking mechanism of FIGS. 5–9.
Figure 10B:
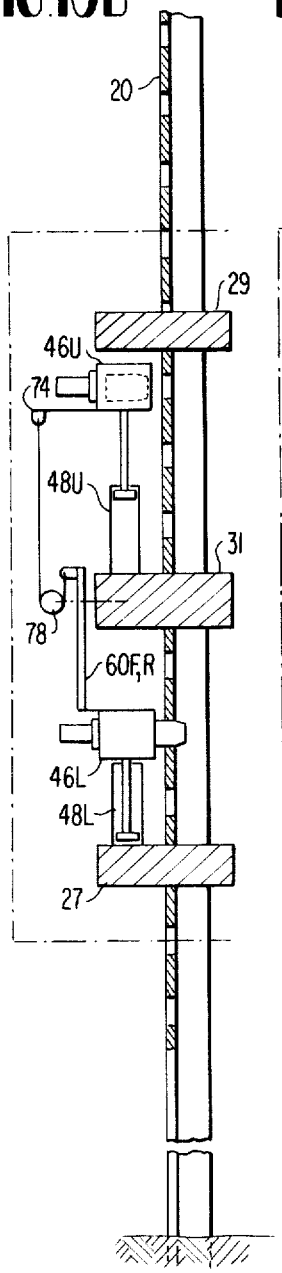

FIGS. 10A–10D schematically depict the operative relationship of the jacking assemblies. It will be realized that once the legs 18 are seated on the waterbed or ocean floor and it is desired to raise the barge along the legs 18, the coupling pin of the extended beam, i.e., the pin 56L of the lower beam 46L of FIG. 10A, is inserted into an aligned opening 24 in the pin carrier 23 of the chord 20. At the same time, the coupling pin of the retracted beam, i.e., the pin 56U of the upper beam 46U, is maintained in a disengaged position relative to the chord 20. By power retracting the lower fluid cylinders 48L, the platform is raised relative to the leg 18 (FIG. 10B). At the same time, the upper fluid cylinders are power extended so as to rasie the upper beam 46U relative to the chord 20 and relative to the cross member 31. In so doing, the force transfer chains 72F, 72R are placed in tension between the upper beam 46U and the posts 60F, 60R and thus exert an upward force on the cross member 31 via the sprockets 78 which are attached to the cross member 31. That is, the upper beam ends of the chain 72F, 72R are raised, thereby imposing a downward thrust on the posts 60F, 60R of the lower beam 46L. Since the lower beam 46L is affixed to the leg chord 20, the posts 60F, 60R define fixed or stationary members. The net effect is the imposition of a lifting action on the cross member 31, to aid in raising the frame structure. In this fashion, the lifting capacity of all of the cylinders 48U, 48L is combined to raise the platform.

Importantly, the above-described arrangement wherein the sprocket wheels are mounted on the cross member, provides a highly balanced load pattern applied against the cross member 31. That is, the forces being exerted against the cross member 31 through the upper power cylinders 48U are effectively countered and resisted by the upward lifting forces being applied to the sprocket wheels 78 intermediate the ends of the cross member. Moreover, as will be apparent from the arrangement of the sprocket wheels 78 (FIG. 5), these forces are balanced by being evenly distributed along the length of the cross member 31 to avoid a concentration of forces at one or more points, which concentration could lead to the formation of unfavorable bending stresses on the cross member. As a result, the cross member 31, supported at its opposite ends, is reinforced by upward lifting forces imposed intermediate its supported ends, thus greatly easing the structural and endurance requirements such as size and strength of the cross member 31, and without seriously limiting the accessibility of the various components of the jacking unit or increasing the cost and weight thereof.

Figure 10C:
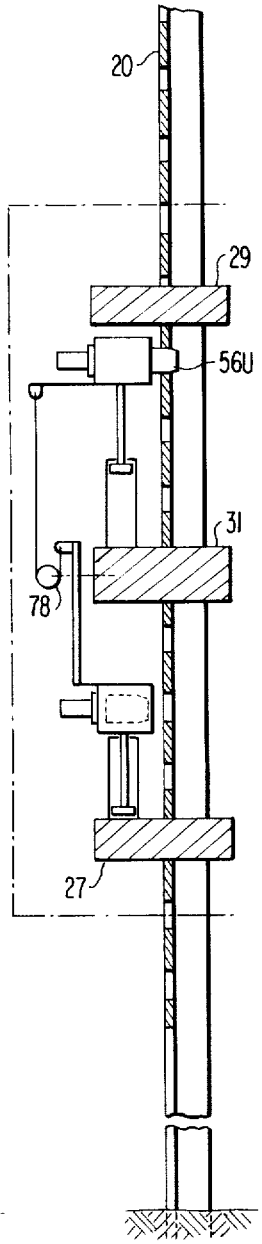
Figure 10D:
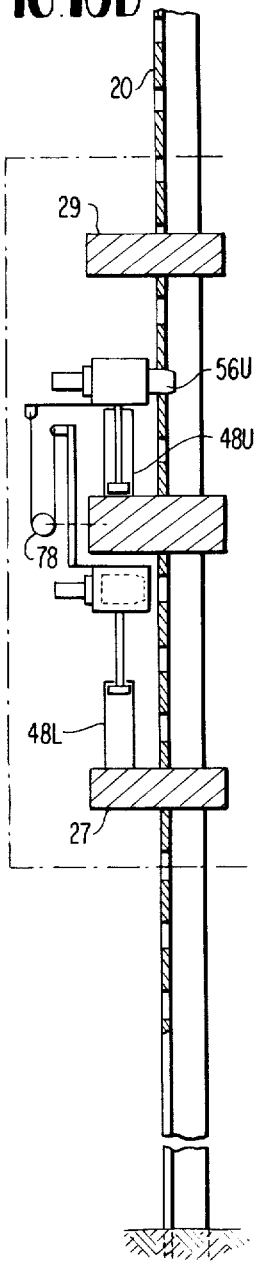

At the end of the extension stroke of the upper cylinders 48U (FIG. 10B), all of the upper and lower power cylinders 48U, 48L are appropriately positioned for a subsequent lifting stroke, i.e., the upper pin 56U is inserted into the pin track of the chord 20 while removing the power pin 56L therefrom (FIG. 10C). In such posture, upward movement of the platform may be continued by retracting the upper fluid clyinders 48U and extending the lower fluid cylinders 48L (FIG. 10D). As a result, the step-by-step lifting action of the jacking mechanism is essentially continuous.

The previously-discussed shock absorber mounting pads 33, 34 find particular utility during initial phases of operation as the legs 18 are being lowered to the waterbed or ocean floor from the platform 10, the latter being floatingly disposed on the water surface. Such lowering operation can be conducted in step-by-step fashion utilizing the jacking unit 25. Due to the self-lowering weight of the legs 18, the power cylinders 48U, 48L initially function to regulate the descent of the legs, as by controlling the exhaust of fluid from the cylinders by suitable valving. Subsequently, it may be necessary to power actuate the cylinders 48U, 48L to overcome buoyancy forces acting on the legs and/or to force the legs 18 sufficiently into the waterbed or ocean floor.

It will be realized that as the legs 18 first touch the waterbed, shock forces are generated. Moreover, swells in the sea will cause the legs to rise off the waterbed or ocean floor and then engage again with severe force. These forces are transmitted to the jacking units 25. However, the jacking units are permitted to float relative to the platform by means of the dual-acting shock absorbing springs 33, 34, 39. Thus, the jacking units 25 are permitted to travel vertically with the legs, with the resilient mountings 33, 34 functioning to absorb shock. Consequently, the shock reaction is reduced in a manner avoiding severe damage to the barge and the jacking units. The resilient mountings, which employ alternately positioned steel sheets and resilient mats, thus provide a strong, yet highly resilient mounting for the jacking frame unit.

PREFERRED EMBODIMENT OF FIG. 11

Figure 11:
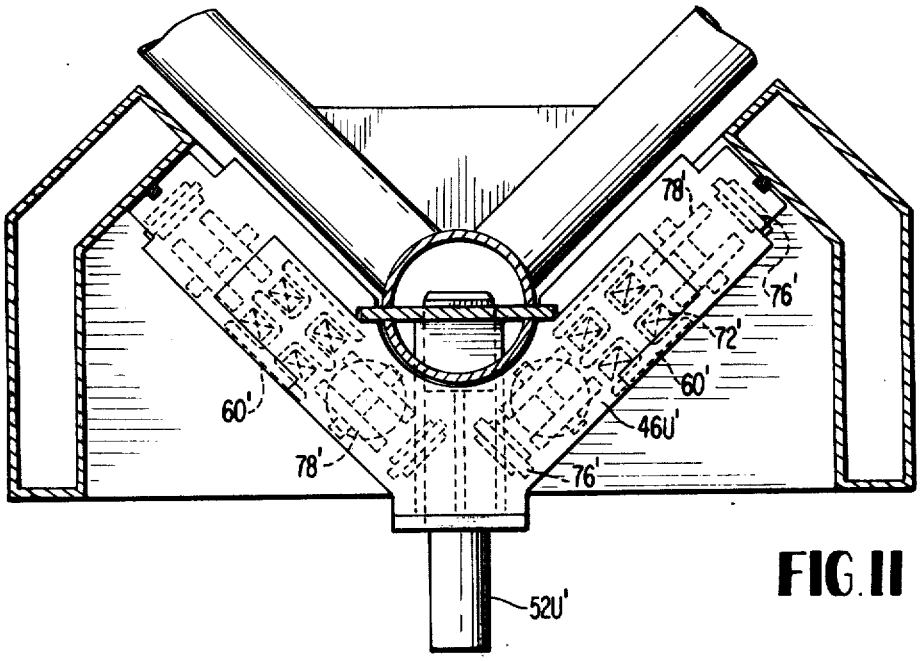
FIG. 11 is a cross-sectional view of another preferred embodiment of the jacking mechanism in accordance with the present invention.

In FIG. 11, there is depicted a compact version of the embodiment depicted in FIGS. 5 through 10. In this embodiment, the upper and lower beams, instead of being straight, are V-shaped in plan. In similar fashion, the cross member (not shown) of the jacking frame structure is similarly V-shaped. The lower beam carries only two thrust posts 60', each of which passes through the cross member and receives the ends of four chains 72', the other ends of the chains being connected to flanges 76' on the upper beam 46U'. The chains are arranged to pass around pairs of coaxial sprocket wheels 78'. A pin mechanism 52U' is disposed at the apex of each V-shaped beam. The operation of the holding mechanism and force transfer chains is essentially the same as described in connection with FIGS. 5 through 10. It will be apparent that the overall width of the jacking mechanism is significantly reduced by the V-shaped arrangement of the upper beams and the cross member, thus rendering the structure more compact.

PREFERRED EMBODIMENT OF FIGS. 12–15

A modified form of the invention is depicted in FIGS. 12 through 15. In this embodiment, a jacking unit 100 comprises an integral frame structure 102, which is mounted at the roof and deck 104, 106 of a jack house by shock absorber couplings 108 similar to those described in conjunction with FIG. 5. An upper jacking assembly is mounted on the frame structure and includes a power cylinder 110U fixedly secured to a cross member 112 of the frame structure. At its piston rod end the power cylinder 110U carries an upper beam or pin carrier 114U. This upper beam 114U supports a pin mechanism 116U similar to that discussed previously. A lower jack assembly includes a power cylinder 110L mounted on the base-section of the frame structure 102. The lower power cylinder 110L is axially aligned with the upper cylinder 110U. The lower fluid cylinder carries a lower beam or pin carrier 114L which in turn carries a lower pin mechanism 116L.

A force transmitting mechanism is operably connected between the upper and lower fluid cylinders. This force-transmitting mechanism includes a rack and pinion assembly 118 wherein a pair of upper racks 120 are mounted on and depend from the upper beam 114U, and a pair of lower racks 122 are mounted on and extend upwardly from the lower beam 114L. The arrangement is such that on each side of an axis of alignment of the power cylinders 110U, 110L, there is cooperatively arranged an upper and a lower rack traveling in spaced parallel relationship in opposite directions. Operably disposed between and in driving connection with, the upper and lower racks at each side of the cross member 112 is a rotatable pinion 124.

The rack and pinion arrangement operates in a similar fashion to the chain sprocket wheel assembly of FIGS. 5 through 10 in that it transfers the power output of the uncoupled fluid cylinder, i.e., whose beam is uncoupled from the leg, to the cross member during jacking operations. For example, it will be apparent that when the upper beam 114U is coupled to the leg 18 via its holding mechanism, its associated racks 120 are maintained in a stationary posture relative to the leg. Consequently, movement of the uncoupled beam 114L will be accompanied by upward movement of its racks 122. It will be realized that with one side of the pinion 124 engaging a stationary rack 120 and its other side being acted on by a moving rack 122, the pinion 124 will travel bodily along the stationary rack. In this manner, extension of the lower cylinder 110L is transmitted to the cross member 112, which carries the pinions 124.

Figure 15:
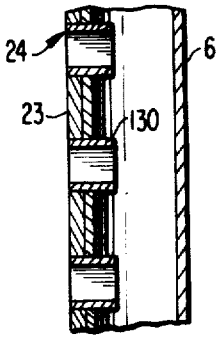
FIG. 15 is a fragmentary vertical-sectional view of a reinforced aperture arrangement for a platform leg.

In FIG. 15, there is depicted one structure of the column leg openings 24. Secured to the plate forming the pin track 23 of the chord 20 are a series of horizontally extending hollow pipe segments 130. These pipe segments extend through respective ones of the openings 24 and are welded or otherwise rigidly fixed thereto to reinforce the openings for reception of the holding pins. It will be appreciated that such an arrangement may be suitably employed in conjunction with any or all of the preferred embodiments discussed herein.

PREFERRED EMBODIMENT OF FIG. 16

Figure 16:
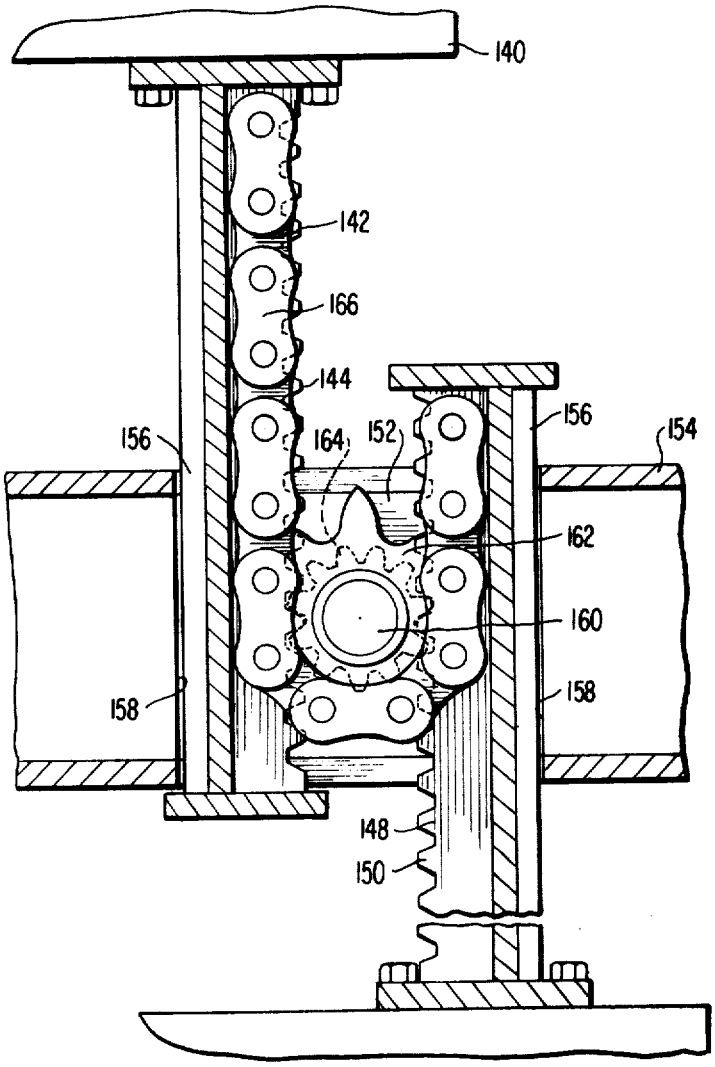
FIG. 16 is a fragmentary side elevational view of another preferred embodiment of the jacking mechanism according to the invention.
Figure 12:
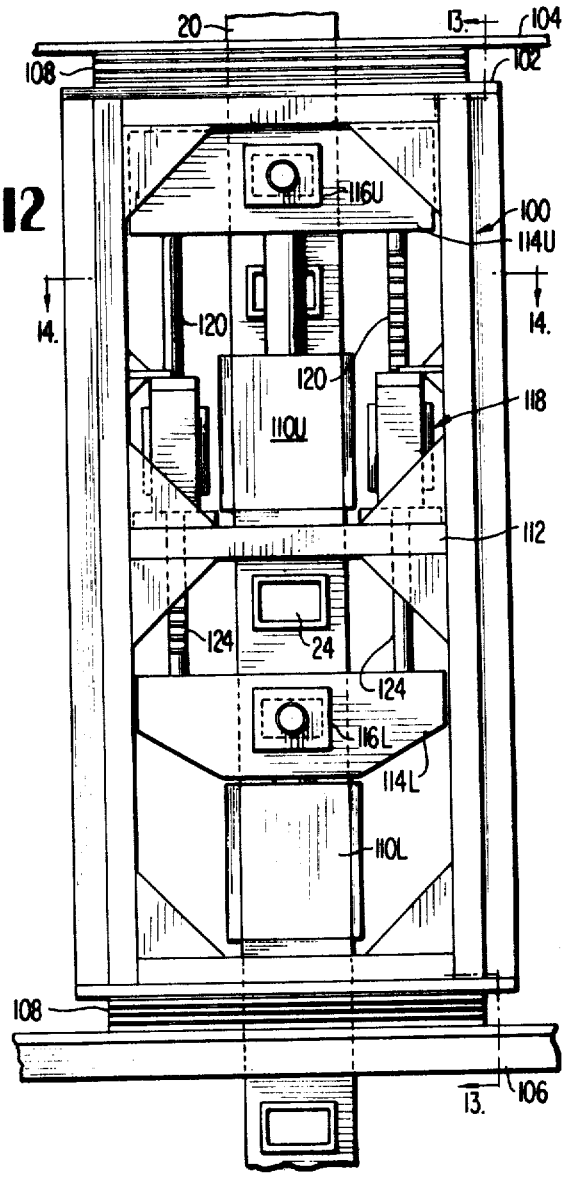
FIG. 12 is a front elevational view of another embodiment of the jacking mechanism according to the invention.

Advantageously, the use of afore-described flexible force transmission elements (FIGS. 5–10) and rack and pinion system (FIGS. 12–14) can be combined. One form of such combination is shown in FIG. 16. The upper beam 140 has, depending therefrom, a plurality of racks 142 (only one shown) which carry a row of teeth 144. Extending upwardly from the lower beam 146 are racks 148 (one shown) which carry rows of teeth 150. The racks 142, 148 are mounted for vertical reciprocal movement within a recess 152 in a cross member 154 which is similar to the cross member 31 of FIG. 5. Each rack 142, 148 has a guide strip 156 which is mounted within bearing slots 158 formed in the cross member 154 and in guided relation thereto. The guide strips 156 can be formed of Teflon or the like to reduce friction.

Rotatably mounted in suitable bearings carried by the cross member 154 are axles 160 (only one shown). Each axle has keyed thereto a pair of coaxial toothed wheels 162, 164 which are rotatably fixed to the axle 160 so as to rotate within the recess 152. The teeth, 144, 150 of the racks 142, 148 operably engage the wheel 164 which functions as a pinion. Thrust is transmitted to the cross member 154 through the wheel 164 and the axle 160 in a manner similar to that discussed in connection with wheel 124 of FIGS. 12–14.

Secured to terminal ends of the racks 142, 148 are the ends of a link chain 166. The chain 166 is connected to the sprocket wheel 162 such that upward movement of one of the beams 140, 146 relative to the other acts through the axle 160 to produce a further thrust on the cross member 154.

The rack and pinion mechanism is fabricated of materials sufficient to carry the entire weight of the platform, thus providing a safety factor in the event of chain failure. It will be appreciated that any desired number or combination of racks and chains may be employed. For example, it may be desirable to employ a pair of chain sprocket wheels and an intermediate pinion on each axle 160.

PREFERRED EMBODIMENT OF FIGS. 17 AND 18

Figure 17:
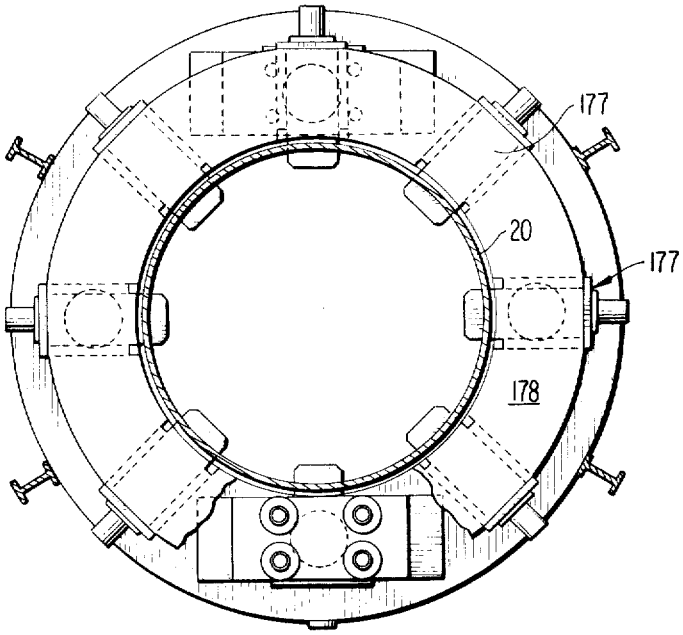
FIG. 17 is a cross-sectional view of another preferred embodiment of the jacking mechanism according to the present invention.
Figure 18:
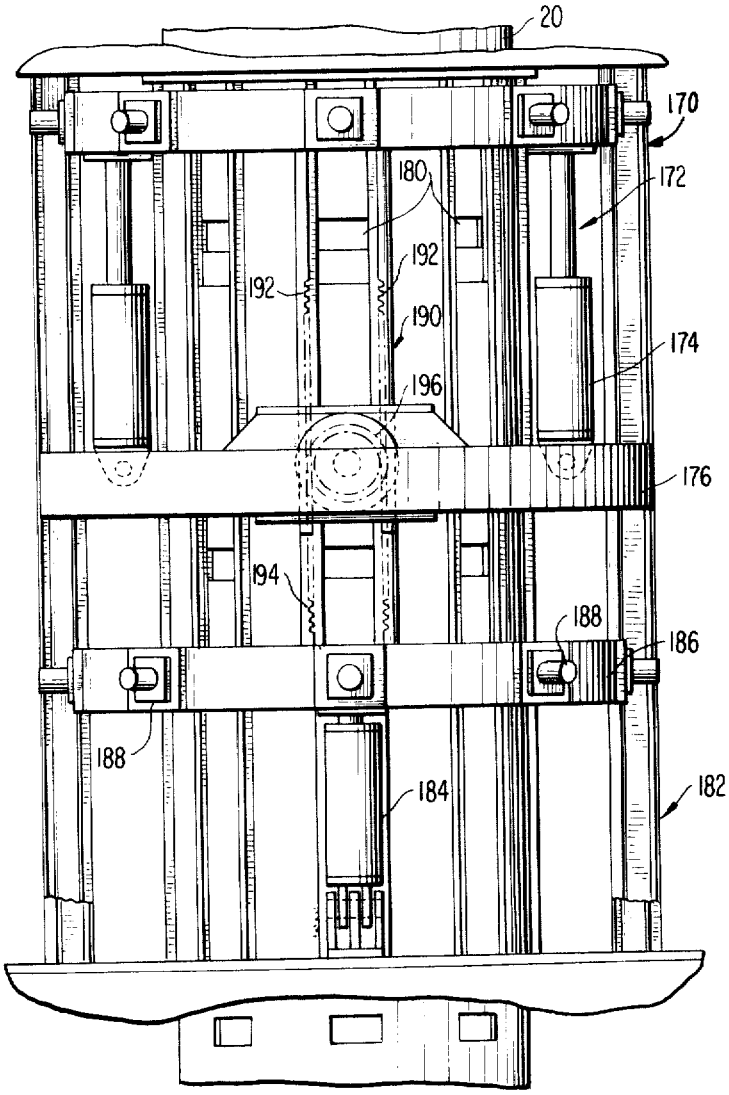
FIG. 18 is a front elevational view of the jacking mechanism depicted in FIG. 17.

In FIGS. 17 and 18, another embodiment of the present invention is depicted. In this embodiment, a jacking mechanism 170 is secured between the deck and roof of the platform jack house. If desired, shock absorber mountings similar to those disclosed in conjunction with FIGS. 5 through 13 could be utilized to isolate shock from the platform legs. An upper jacking assembly 172 includes a pair of fluid cylinders 174 mounted to a cross member 176 of the jacking mechanism frame structure. These fluid cylinders carry an upper beam or pin carrier 178 which is of substantially circular construction and which extends around a leg chord 20. A plurality of pin mechanisms 177, eight being depicted, are carried by the upper beam 178. The leg chord 20 includes a plurality of rows of openings 180 spaced circumferentially in accordance with the circumferential spacing of the pin mechanisms.

This jacking assembly 170 includes a lower fluid cylinder 184 which carries a circular lower beam 186 similar in construction to the upper beam. The lower beam carries a plurality of pin mechanisms 188.

Figure 13:
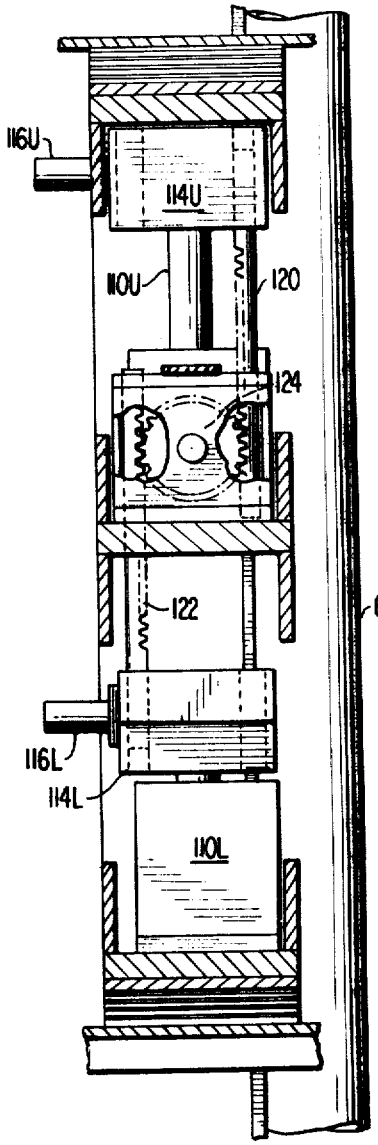
FIG. 13 is a vertical sectional view taken along line 13—13 in FIG. 12.
Figure 14:
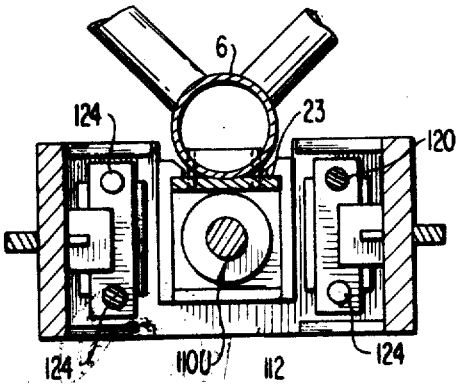
FIG. 14 is a cross-sectional view taken along line 15—15 in FIG. 13.

Connected between the upper and lower fluid cylinders is a power transmitting system which comprises a rack and pinion assembly 190 operating under principles similar to that discussed in conjunction with FIGS. 13–15, i.e., the upper beam 178 carries a pair of downwardly depending racks 192, and the lower beam 186 carries a pair of upwardly extending racks 194. Mounted to the cross member 176 are a pair of pinions 196 (only one being shown), which are operably connected to the racks to transmit thrust to the platform as previously described. Support beams 182 join the top of the leg sleeve or jack house roof to the barge deck.

It will be realized that a plurality of pin mechanisms, evenly located around the leg chord 20 provide a more uniform distribution of forces between the jacking mechanism and the chord and reduce the loading which must be withstood by each pin mechanism. Such a jacking mechanism would be ideally suited in conjunction with platforms of relatively large size and weight using cylindrical legs.

PREFERRED EMBODIMENT OF FIGS. 19–21

Figure 19:
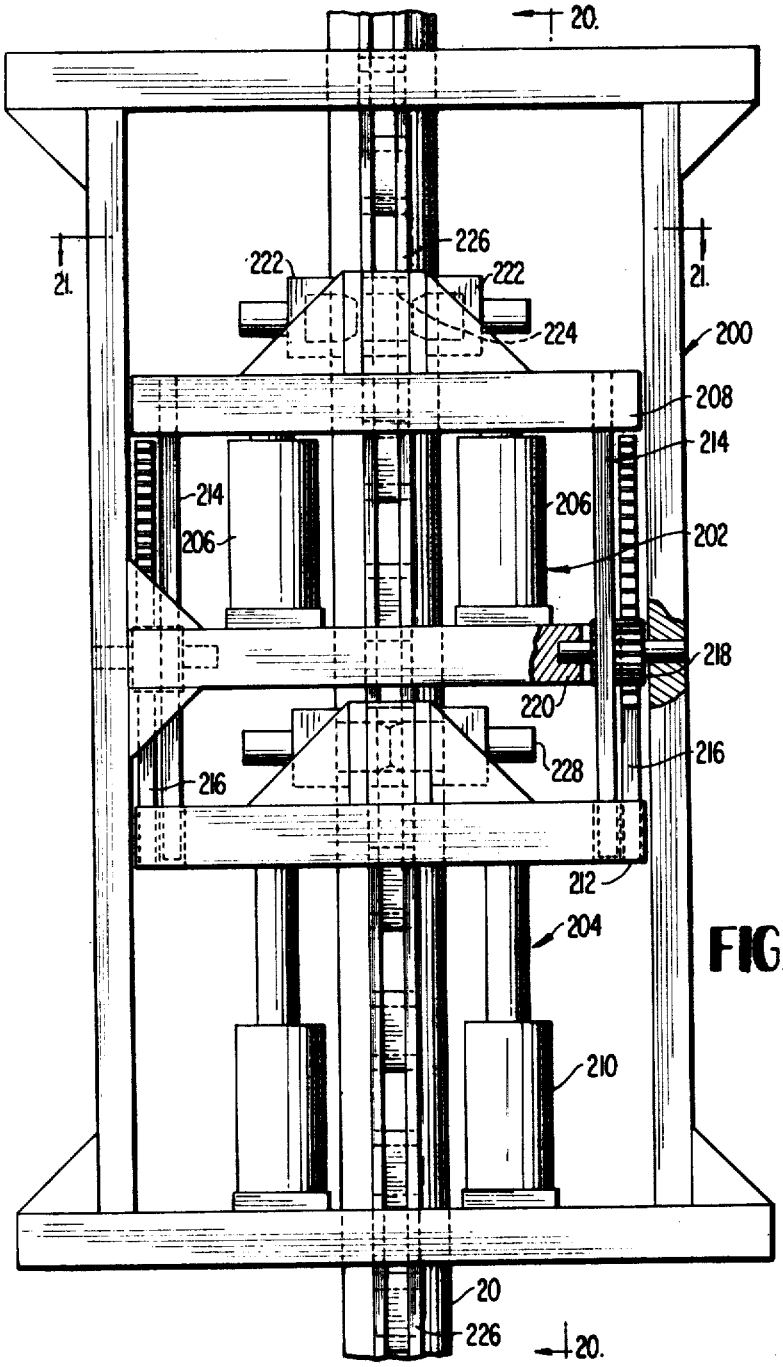
FIG. 19 is a front elevational view of another preferred embodiment of the jacking mechanism according to the invention.
Figure 20:
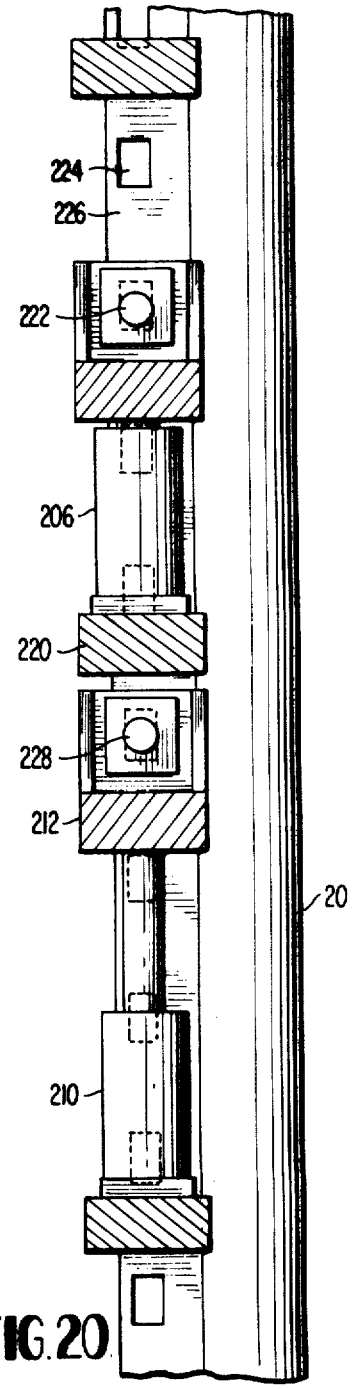
FIG. 20 is a vertical section view taken along line 20—20 in FIG. 19.
Figure 21:
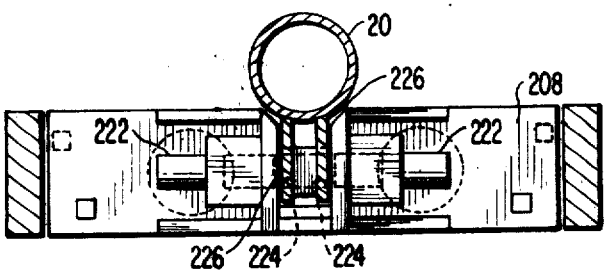
FIG. 21 is a cross-sectional view taken along line 21—21 in FIG. 19.

In a further embodiment of the present invention, depicted in FIGS. 19 through 21, a jacking mechanism 200 includes upper and lower jacking assemblies 202, 204. The upper jacking assembly 202 includes a pair of fluid cylinders 206 which are operable to raise and lower an upper beam 208. In the lower jack assembly 204, a pair of fluid cylinders 210 are operable to raise and lower a lower beam 212. The upper beam 208 carries depending racks 214, and the lower beam 212 carries upwardly extending racks 216. The racks are operably connected at opposite sides of the jacking frame to a pair of pinions 218 which are pivotally connected to a cross-member 220 of the frame assembly. The operation of the rack and pinion assembly 214, 216, 218 is similar to that discussed previously in connection with the rack and pinion assemblies of FIGS. 13–15.

The upper beam carries a pair of pin mechanisms 222. The pin mechanisms include power-actuated pins arranged such that the pins are movable respectively toward and away from one another into and out of contact with aligned openings 224 in the pin track. The openings are formed in spaced plates 226 rigidly attached to the leg chord 20. In similar fashion, the lower beam 212 carries a pair of pin mechanisms 228 whose power-actuated pins are movable toward and away from one another into and out of engagement with the aligned holes 224.

As can be viewed in FIG. 20, the vertical plane containing the fluid cylinders 206, 210 is essentially coextensive with the vertical plane containing the pin mechanisms. As a result, the bending forces imposed on the frame structure are greatly minimized.

PREFERRED EMBODIMENT OF FIG. 22

Figure 22:
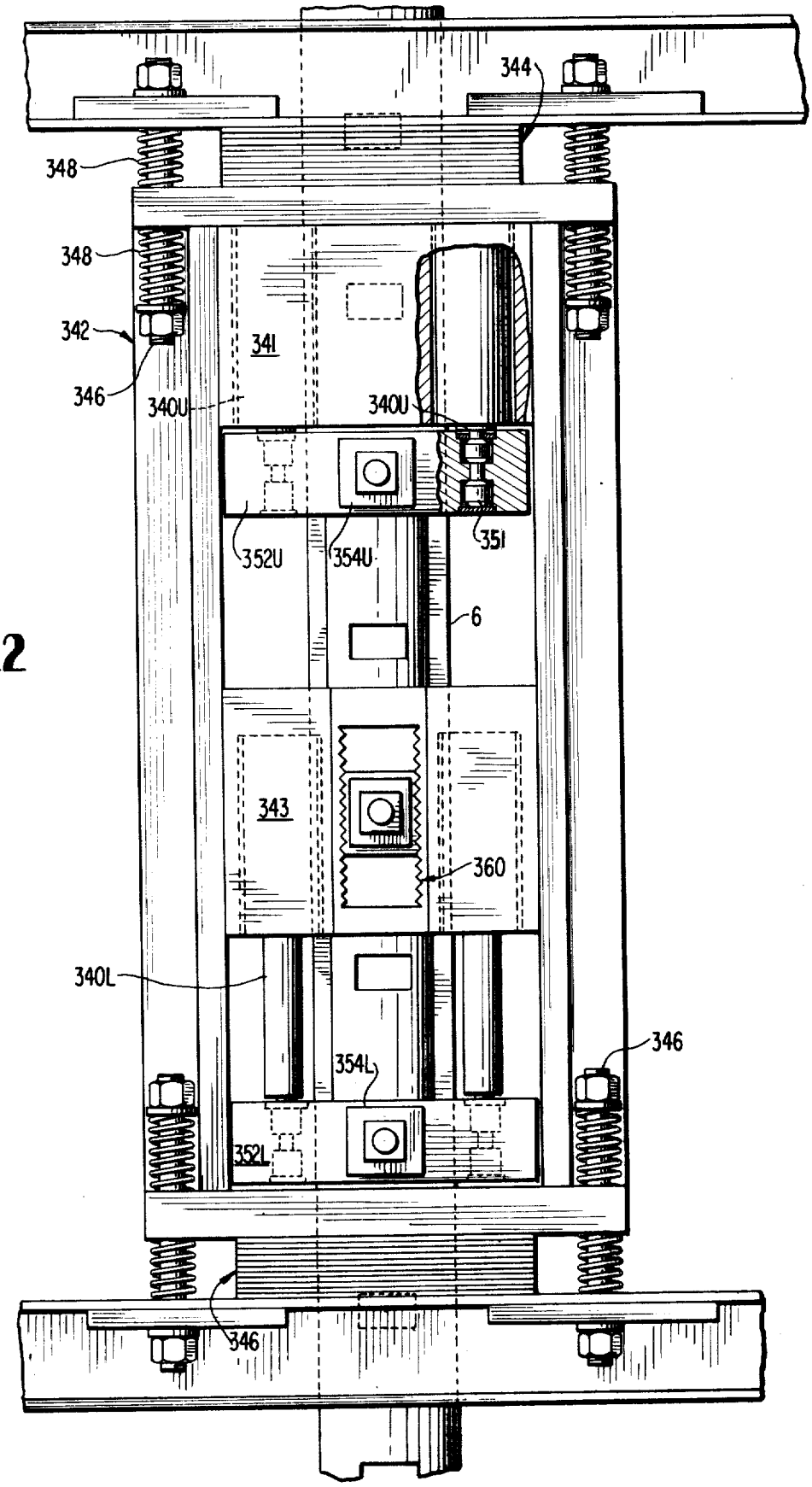
FIG. 22 is a front elevational view of a further preferred form of jacking mechanism in accordance with the present invention.

In another embodiment of the invention, depicted in FIG. 22, a pair of upper hydraulic power cylinders 340U are carried by a first cross member 341 of a jacking frame unit 342. A pair of lower hydraulic cylinders 340L are carried by a second cross member 343 of the frame unit 342. The frame unit 342 is connected to the roof and deck of the platform by shock absorber pad units 344, 346. These units are similar to those previously described, except that the connecting bolts 346 are located outwardly of the shock absorber pads, and coiled compression springs 348 are disposed on both ends of the bolts.

The upper and lower hydraulic cylinders 340U, 340L are inverted relative to the positions previously described, i.e., the piston rods 350U, 350L project downwardly rather than upwardly. The piston rods 350U, 350L carry movable beams 352U, 352L at their lower ends. The rods preferably include a pair of balls 351 fixed at the ends of the rods and which are seated in ball seats of the movable beams. These beams carry pin mechanisms 354U, 354L. Due to the inverted arrangement of the power cylinders and beams relative to that previously described, upward jacking of the platform is accomplished by introducing hydraulic fluid at the piston head ends of the cylinders, rather than at the rod ends of the cylinders as done in the earlier discussed embodiments. As will be understood by one familiar with hydraulics, this results in a greater force capacity during raising of the platform due to the greater piston area being acted upon. Generally the highest output capacity of the cylinders would be expected during raising of the platform. Now such forces can be provided individually by each cylinder. During platform lowering operations or leg-raising operations, the forces produced from the rod ends of the pistons will be sufficient to permit step-by-step movement in the normal fashion. As a result, the force transfer mechanism extending between the cylinders has been eliminated. It will be understood that in the event that heavy loads are encountered, extra capacity can be obtained by operating the cylinders in unison. In FIG. 22 there is also depicted an auxiliary holding mechanism 360 mounted in the second cross member 342 for mating engagement with the leg.

Although the invention has been described in several embodiments thereof, it will be appreciated that additions, modifications, substitutions and deletions not specifically described may be made without departing from the spirit and scope of the invention as defined in the appended claims.

I claim:

1. Jacking apparatus for effecting relative vertical movement between an upright leg and a platform, said jacking apparatus comprising:

frame means, including generally horizontally spaced support means mounted on said platform and a generally horizontal cross member supported at horizontally spaced locations by said support means;

first fluid cylinder means carried by said platform and being mounted on said cross member in a generally upright position;

said first fluid cylinder means being selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means carried by said platform vertically remote from said cross member at a location which is vertically spaced from said cross member so that said second fluid cylinder means is disposed in vertically spaced relation relative to said first fluid cylinder means;

said second fluid cylinder means being selectively extendable and retractable in reverse phase relation to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second fluid cylinder means produces relative movement between said platform and said leg;

said first and second holding means being operable to couple first and second beam means to said leg in alternative sequence; and power transfer means operably connecting said cross member to said first and second fluid cylinder means to transfer lifting forces directly to said cross member from the one of said first and second fluid cylinder means whose associated beam means is uncoupled from said leg, to augment forces being applied to said platform by the other of said first and second fluid cylinder means.

2. Jacking apparatus according to claim 1 wherein said power transfer means comprises a plurality of rotary wheels carried by said cross-member, and an elongated flexible device operably connected to each wheel, with the opposite ends of said elongate flexible device having its ends operably connected to said first and second beam means.

3. Jacking apparatus according to claim 2 wherein said power transfer means further comprises a plurality of upright thrust posts carried by the lowermost one of said beam means, with said flexible device being connected to said posts at points disposed above said rotary wheels.

4. Jacking apparatus according to claim 3 wherein said wheels comprise sprocket wheels and said flexible device comprise chains.

5. Jacking apparatus according to claim 2 wherein said beams are generally V-shaped when viewed from above so as to extend along opposite sides of said leg.

6. Jacking apparatus according to claim 1 wherein said power transfer means comprises toothed rack members connected to said first and second beam means and operably connected to associated pinion wheels rotatably carried by said cross-member.

7. Jacking apparatus according to claim 2 wherein said power transfer means comprises toothed rack members connected to said first and second beam means and operably connected to associated pinion wheels rotatably carried by said cross-member.

8. Jacking apparatus according to claim 1 wherein said first and second beam means comprise curved beam members extending around the periphery of said leg, with each beam member carrying a plurality of holding means.

9. Jacking apparatus according to claim 1 wherein said first and second beam means each carry a pair of holding means, each holding means carrying a power-extendable and retractable pin movable into and from connection with an aperture in said leg; each pair of holding means being arranged such that their associated pins are aligned and travel toward and away from one another during extension and retraction relative to aligned openings therebetween.

10. Jacking apparatus according to claim 1 and further comprising frame means carrying said first and second power cylinder means, said frame means including said cross member; and shock absorber means mounting said frame means to said platform, said shock absorber means including resiliently yieldable means permitting limited relative movement between said frame means and said platform to isolate said platform from shock transmitted through said leg; said yieldable means being arranged to act simultaneously upon upper and lower portions of said frame means during movement of said frame means.

11. Jacking apparatus according to claim 1 and further comprising auxiliary holding means operable independently of said first and second holding means, said auxiliary holding means comprising a fixture mounted on said platform, a slot in said fixture defined by a plurality of grooves, and securing means having mating grooves so as to be insertable in said slot at variable heights, and a pin insertable through an aligned recess in said leg..

12. Jacking apparatus adopted to be carried by a platform for effecting relative vertical movement between an upright leg and the platform, said jacking apparatus being disposed between vertically spaced support surfaces of said platform and comprising:

a support frame structure including a base section, side sections, and a top section, and a cross-member extending between said side sections intermediate the upper and lower ends of said side sections; said base, side and top sections and said cross-member being rigidly secured together to define an integral frame assembly connectable as a unit to said support surfaces;

first fluid cylinder means being mounted on said cross-member in a generally upright position and selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means mounted to said base section and selectively extendable and retractable in reverse phase relative to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second cylinder means produces relative movement between said platform and said leg;

power transfer means operably connecting said cross member to said first and second fluid cylinder means to transfer forces directly to said cross member from the one of said first and second fluid cylinder means whose associated beam means is uncoupled from said leg, said forces being oriented to augment the forces being applied from the other of said first and second fluid cylinder means; and shock absorber means mounting said support frame assembly to said support surfaces including;

first means for guiding said top frame section for upward and downward movement relative to said platform and for limiting the extent of such movement, first double-acting spring means for absorbing forces during both upward and downward travel of said top frame section second means for guiding said base frame section for upward and downward movement relative to said platform and for limiting the extent of such movement, and second double-acting spring means for absorbing forces during both upward and downward travel of said base frame section.

13. Jacking apparatus according to claim 12 wherein said shock absorber means comprises top and bottom resilient pad means situated at the top and bottom of said support frame structure, and bolt means associated with said top and bottom pad means for connecting said base section and said lower pad means to a lower one of said support surfaces and for connecting said top section and said upper pad means to an upper one of said support surface.

14. Jacking apparatus according to claim 12 wherein said shock absorber means comprises resilient pad means interposed between said platform and said leg; said pad means comprising alternate sheets of metal and resilient material.

15. Jacking apparatus according to claim 14 and further including bolts connecting said base section to a lower one of said support surfaces, said bolts having springs mounting said frame structure for biased movement relative to said lower support surface.

16. Jacking apparatus for effecting relative vertical movement between an upright leg and a platform, said jacking apparatus comprising:

vertically spaced upper and lower support structures carried by said platform;

said upper support structure being supported at its ends;

first power means mounted on said upper support structure;

a first movable member connected to said first power means for vertical movement in response to actuation of said first power means;

first holding means carried by said first movable member for selectively coupling said first movable member against vertical movement relative to said leg, wherein actuation of said first power means produces relative movement between said platform and said leg;

second power means mounted on said lower support structure;

a second movable member connected to said second power means for vertical movement in response to actuation of said second power means;

second holding means carried by said second movable member for selectively coupling said second movable member against vertical movement relative to said leg, wherein actuation of said second power means produces relative movement between said platform and said leg; and power transfer means operably connecting said upper support structure to said first and second movable members to transfer forces to said upper support structure from both of said first and second power means during jacking of said platform by reverse-phase operation of said movable members.

17. Jacking apparatus for effective relative vertical movement between an upright leg and a platform, said jacking apparatus comprising:

frame means, including a pair of upper and lower vertically spaced cross members, mounted on the platform above a floor of the platform;

first fluid cylinder means carried by said lower cross member and including:

a first cylinder mounted on and encased within said lower cross member and projecting downwardly therefrom, said first cylinder being closed at its top end and open at its downward end;

a first piston reciprocally mounted in said first cylinder and including a head side and a rod side, and a first rod fixed to said rod side of said first piston and projecting outwardly of the downward end of said first cylinder so as to be vertically shiftable in response to the introduction of pressure fluid against said head and rod sides of said first piston;

first beam means operably connected to the lower end of said first rod for vertical movement relative to said platform in response to extension and retraction of said first rod;

said lower end of said first rod being encased within said first beam means;

first holding means for selectively coupling said first beam means against vertical movement relative to said leg wherein actuation of said first fluid cylinder means produces relative movement between said platform and said leg;

second fluid cylinder means carried by said upper cross member and including:

a second cylinder mounted on and encased within said upper cross member and projecting downwardly therefrom, said second cylinder being closed at its top end and open at its downward end;

a second piston reciprocally mounted in said second cylinder and having a head side, a rod side, and a second rod fixed to said rod side of said second piston and projecting outwardly of the downward end of said second cylinder, so as to be vertically shiftable in response to the introduction of pressive fluid against said head and rod sides of said second piston;

second means operably connected to the lower end of said second rod for vertical movement relative to said platform in response to extension and retraction of said second rod;

said lower end of said second rod being encased within said second beam means;

second holding means for selectively coupling said second beam means against vertical movement relative to said leg wherein actuation of said second fluid cylinder means produces relative movement between said platform and said leg;

said first and second holding means being operable to couple fist and second beam means to said leg in alternative sequence;

the arrangement being such that each beam means is operable to raise said platform along said leg with its respective beam means being coupled against vertical movement relative to said leg and with pressurized fluid being introduced against the head end of its associated piston rod;

first shock absorber means connected between said platform and an upper end of said frame means; and second shock absorber means connected between said platform and a lower end of said frame means;

said first and second shock absorber means each including resiliently yieldable means permitting relative movement between said frame means and said platform tending to isolate said platform from shock transmitted through said leg;

said yieldable means of said first and second shock absorber means being arranged to act simultaneously upon said upper and lower ends of said frame means during movement of said frame means.

18. Jacking apparatus according to claim 17 wherein said first and second shock absorber means comprises top and bottom resilient pad means situated at the top and bottom of said support frame structure, and bolt means associated with each of said top and bottom pad means for connecting said frame means and said bottom pad means to said floor and for connecting said frame means and said top pad means to a stationary support surface spaced above said floor.

19. Jacking apparatus according to claim 17 wherein said shock absorber means comprises resilient pad means interposed between said platform and said frame means; said pad means comprising alternate sheets of metal and resilient material.

20. Jacking apparatus for effecting relative vertical movement between an upright leg and a platform, said jacking apparatus comprising:

frame means, including a cross member, mounted on a platform;

first fluid cylinder means carried by said platform and being mounted on said cross member in a generally upright position;

said first fluid cylinder means being selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means carried by said platform in vertically spaced relation relative to said first fluid cylinder means;

said second fluid cylinder means being selectively extendable and retractable in reverse phase relation to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second fluid cylinder means produces relative movement between said platform and said leg;

said first and second holding means being operable to couple first and second beam means to said leg in alternative sequence;

power transfer means operably connecting said cross member to said first and second fluid cylinder means to transfer forces directly to said cross member from the one of said first and second fluid cylinder means whose associated beam means is uncoupled from said leg, said forces being oriented to augment forces being applied by the other of said first and second fluid cylinder means, said power transfer means comprising:

a plurality of upright thrust posts carried by the lowermost one of said beam means, a plurality of rotary wheels carried by said cross member, and an elongated flexible device operably connected to each wheel, one end of each flexible device being connected to the uppermost one of said beam means and the other end of each flexible device being connected to a thrust post at a point disposed above said rotary wheels.

21. Jacking apparatus for effecting relative vertical movement between an upright leg and a platform, said jacking apparatus comprising:

frame means, including a cross member, mounted on the platform;

first fluid cylinder means carried by said platform and being mounted on said cross-member in a generally upright position;

said first fluid cylinder means being selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means carried by said platform in vertically spaced relation relative to said first fluid cylinder means;

said second fluid cylinder means being selectively extendable and retractable in reverse phase relation to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second fluid cylinder means produces relative movement between said platform and said leg;

said first and second holding means being operable to couple first and second beam means to said leg in alternative sequence;

power transfer means operably connecting said cross-member to said first and second fluid cylinder means to transfer forces directly to said cross member from the one of said first and second fluid cylinder means whose associated beam means is uncoupled from said leg, said forces being oriented to augment forces being applied by the other of said first and second fluid cylinder means;

said power transfer means comprising toothed rack members connected to said first and second beam means and operably connected to associated pinion wheels rotatably carried by said cross member.

22. Jacking apparatus for effecting relative vertical movement between an upright leg and a platform, said jacking apparatus comprising:

frame means, including a cross member, mounted on the platform;

first fluid cylinder means carried by said platform and being mounted on said cross-member in a generally upright position;

said first fluid cylinder means being selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means carried by said platform in vertically spaced relation relative to said frst fluid cylinder means;

said second fluid cylinder means being selectively extendable and retractable in reverse phase relation to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second fluid cylinder means produces relative movement between said platform and said leg;

said first and second holding means being operable to couple first and second beam means to said leg in alternative sequence;

power transfer means operably connecting said cross-member to said first and second fluid cylinder means to transfer forces directly to said cross member from the one of said first and second fluid cylinder means whose associated beam means is uncoupled from said leg, said forces being oriented to augment forces being applied by the other of said first and second fluid cylinder means;

said power transfer means comprising a plurality of rotary pinion wheels rotatably carried by said cross member, toothed rack members connected to said first and second beam means and operably connected to associated ones of said pinion wheels, and an elongated flexible device operably connected to each wheel with the opposite ends of said elongate flexible device having its end operably connected to said first and second beam means.

23. Jacking apparatus for effecting relative vertical movement between an upright leg and a platform, said jacking apparatus comprising:

frame means, including a cross member, mounted on the platform;

first fluid cylinder means carried by said platform and being mounted on said cross-member in a generally upright position;

said first fluid cylinder means being selectively extendable and retractable;

first beam means operably connected to said first fluid cylinder means for vertical movement relative to said platform in response to extension and retraction of said first fluid cylinder means;

first holding means for selectively coupling said first beam means against vertical movement relative to said leg wherein actuation of said first fluid cylinder means produces relative movement between said platform and said leg;

second fluid cylinder means carried by said platform in vertically spaced relation relative to said first fluid cylinder means;

said second fluid cylinder means being selectively extendable and retractable in reverse phase relation to said first fluid cylinder means;

second beam means operably connected to said second fluid cylinder means for vertical movement relative to said platform in response to extension and retraction of said second fluid cylinder means;

second holding means for selectively coupling said second beam means against vertical movement relative to said leg wherein actuation of said second fluid cylinder means produces relative movement between said platform and said leg;

said first and second holding means being operable to couple first and second beam means to said leg in alternative sequence;

power transfer means operably connecting said cross-member to said first and second fluid cylinder means to transfer forces directly to said cross member from the one of said first and second fluid cylinder means whose associated beam means is uncoupled from said leg, said forces being oriented to augment forces being applied by the other of said first and second fluid cylinder means; and auxiliary holding means operable independently of said first and second holding means, said auxiliary holding means comprising a fixture mounted on said platform, a slot in said fixture defined by a plurality of grooves, and securing means having mating grooves so as to be insertable in said slot at variable heights, and a pin insertable through an aligned recess in said leg.

* * * * *